US008701353B2

(12) United States Patent
Patel et al.

(10) Patent No.: US 8,701,353 B2
(45) Date of Patent: Apr. 22, 2014

(54) DEPLOYABLE DOOR HANDLE FOR VEHICLES

(75) Inventors: Rajesh K. Patel, Farmington Hills, MI (US); Kosta Papanikolaou, Hungtingdon Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/616,631

(22) Filed: Sep. 14, 2012

(65) Prior Publication Data

US 2014/0000167 A1 Jan. 2, 2014

Related U.S. Application Data

(60) Provisional application No. 61/666,280, filed on Jun. 29, 2012.

(51) Int. Cl.
*E06B 3/00* (2006.01)

(52) U.S. Cl.
USPC ..... 49/503; 292/336.3; 292/144; 292/201; 292/DIG. 31

(58) Field of Classification Search
USPC ..... 49/460, 503; 292/336.3, 144, 201, 170, 292/224, 197, DIG. 31, DIG. 4
See application file for complete search history.

(56) References Cited

U.S. PATENT DOCUMENTS 4,703,963 A 11/1987 Ball
4,895,403 A 1/1990 Osenkowski
5,248,175 A * 9/1993 Burns ..... 292/347
5,369,911 A * 12/1994 Fortunato ..... 49/25
5,560,659 A * 10/1996 Dault ..... 292/336.3
5,632,516 A * 5/1997 Schwab ..... 292/336.3
5,669,642 A 9/1997 Kang
5,862,896 A * 1/1999 Villbrandt et al. ..... 188/293
6,367,124 B1 * 4/2002 Bella et al. ..... 292/336.3
6,530,251 B1 * 3/2003 Dimig ..... 70/237
6,588,813 B1 7/2003 Marcarini et al.
6,598,913 B2 7/2003 Meinke
6,698,262 B2 * 3/2004 Wittwer ..... 70/208
6,740,834 B2 5/2004 Sueyoshi et al.
6,923,481 B2 8/2005 Bruderick et al.
6,933,831 B2 8/2005 Ieda et al.
6,998,968 B2 2/2006 Garnault et al.
7,055,997 B2 6/2006 Baek
7,108,301 B2 9/2006 Louvel
7,173,346 B2 2/2007 Aiyama et al.
7,199,317 B2 4/2007 Ieda et al.
7,217,899 B2 5/2007 Hidaka et al.
7,300,190 B2 11/2007 Nitawaki et al.
7,375,299 B1 5/2008 Pudney
7,446,645 B2 * 11/2008 Steegmann et al. ..... 340/5.72
7,543,863 B2 * 6/2009 Herbert et al. ..... 292/336.3
7,621,573 B2 11/2009 Thomas et al.

(Continued)

*Primary Examiner* — Jerry Redman
(74) *Attorney, Agent, or Firm* — Raymond Coppiellie; Prince Heneveld LLP

(57) ABSTRACT

A flush door handle includes a powered actuator that shifts the handle from a fully retracted position to an intermediate position. A user can then grasp the handle, and pull the handle to a fully open position to thereby unlatch the door latch. After a user releases the handle, it shifts to a closed position due to spring force or a powered actuator. The door latch may also comprise a fully powered version wherein the handle shifts from a closed position to an open position, and a powered door latch releases the door latch if predefined conditions are detected.

19 Claims, 11 Drawing Sheets

(56) References Cited

U.S. PATENT DOCUMENTS

| | | | | |
|---|---|---|---|---|
| 7,751,664 | B2 | 7/2010 | Ieda et al. | |
| 7,810,856 | B2 * | 10/2010 | Muller et al. | 292/336.3 |
| 7,891,886 | B2 * | 2/2011 | Schuetz | 396/427 |
| 7,931,314 | B2 | 4/2011 | Nitawaki et al. | |
| 7,984,937 | B2 | 7/2011 | Tanimoto et al. | |
| 8,146,393 | B2 * | 4/2012 | Katagiri et al. | 70/208 |
| 8,359,889 | B2 * | 1/2013 | Katagiri et al. | 70/215 |
| 8,403,384 | B2 * | 3/2013 | Ieda et al. | 292/336.3 |
| 8,408,611 | B2 * | 4/2013 | Takagai et al. | 292/336.3 |
| 2002/0121786 | A1 | 9/2002 | Meinke | |
| 2003/0001729 | A1 | 1/2003 | Ieda et al. | |
| 2003/0122556 | A1 | 7/2003 | Sueyoshi et al. | |
| 2004/0135380 | A1 | 7/2004 | Bruderick et al. | |
| 2004/0177478 | A1 | 9/2004 | Louvel | |
| 2004/0217601 | A1 | 11/2004 | Garnault et al. | |
| 2005/0230237 | A1 | 10/2005 | Ieda et al. | |
| 2005/0231364 | A1 | 10/2005 | Nitawaki et al. | |
| 2005/0236846 | A1 | 10/2005 | Hidaka et al. | |
| 2006/0143857 | A1 | 7/2006 | Freyholdt et al. | |
| 2007/0091627 | A1 | 4/2007 | Nitawaki et al. | |
| 2007/0216174 | A1 | 9/2007 | Tanimoto et al. | |
| 2008/0061933 | A1 | 3/2008 | Ieda et al. | |
| 2008/0250607 | A1 | 10/2008 | Ito | |
| 2009/0039671 | A1 * | 2/2009 | Thomas et al. | 296/146.1 |
| 2009/0279826 | A1 | 11/2009 | Ieda et al. | |
| 2009/0309971 | A1 * | 12/2009 | Schuetz | 348/148 |
| 2010/0187838 | A1 | 7/2010 | Ieda et al. | |
| 2010/0192329 | A1 | 8/2010 | Ieda et al. | |
| 2010/0205780 | A1 | 8/2010 | Ieda et al. | |
| 2010/0271049 | A1 | 10/2010 | Van Gastel et al. | |
| 2011/0025522 | A1 | 2/2011 | Peschl et al. | |
| 2011/0148575 | A1 | 6/2011 | Sobecki et al. | |
| 2011/0260831 | A1 | 10/2011 | Ieda et al. | |
| 2012/0019014 | A1 | 1/2012 | Tateishi et al. | |
| 2012/0119524 | A1 * | 5/2012 | Bingle et al. | 292/336.3 |
| 2012/0133159 | A1 | 5/2012 | Tateishi et al. | |
| 2012/0133563 | A1 | 5/2012 | Naka | |
| 2012/0205924 | A1 | 8/2012 | Muller et al. | |
| 2012/0247161 | A1 | 10/2012 | Muller et al. | |
| 2013/0076048 | A1 * | 3/2013 | Aerts et al. | 292/336.3 |

* cited by examiner

DEPLOYABLE DOOR HANDLE FOR VEHICLES

CROSS REFERENCE TO RELATED APPLICATION

This application claims the benefit of U.S. Provisional Application No. 61/666,280, filed Jun. 29, 2012, entitled, DEPLOYABLE DOOR HANDLE FOR VEHICLES, the entire contents of which are incorporated herein by reference.

FIELD OF THE INVENTION

The present invention relates to a flush-mounted door handle for vehicles that deploys from a retracted/flush position to an extended/presented position.

BACKGROUND OF THE INVENTION

Vehicle door handles typically protrude from the door, and interfere with vehicle styling and/or aerodynamics. Various outside door handles such as paddle type handles, pull-strap handles, push-dash button activated handles, and the like have been developed. However, known door handles for motor vehicles and the like may suffer from various drawbacks.

BRIEF SUMMARY OF THE INVENTION

One aspect of the present invention is a vehicle door including a deployable handle system. The door comprises a door of the type that is, in use, movably mounted to a vehicle for movement between open and closed positions. The door includes a support structure and a smooth exterior side surface that is visible from the outside of the vehicle. The door may have an outwardly-facing pocket and a peripheral edge extending around the pocket to define an edge of the pocket. The door further includes a latch mechanism having a latch member that moves between retained and released positions. A handle member is movably connected to the handle support structure for movement in a first direction from a retracted position to a deployed position, and for movement in a second direction from the deployed position to the retracted position. The handle member has oppositely-facing inner and outer surfaces and a peripheral outer surface extending around the handle member and defining an outer edge. The outer edge of the handle fits closely adjacent the edge of the pocket, or it may be flush to the outer skin of the door. The outer edge of the handle substantially closes off access to the inner surface of the handle member when the handle member is in the retracted position. At least a portion of the outer edge of the handle member is spaced apart from the peripheral inner surface of the pocket to define a gap or finger clearance opening when the handle member is in the deployed position such that a users' fingers can be inserted through the gap enabling a users' fingertips to contact the inner surface of the handle member, enabling a user to use a 360 degree grip to pull on the door to move the door from a closed position to an open position. The door further includes a powered actuator operably connected to the handle to provide powered movement of the handle in at least one of the first and second directions and to thereby selectively open or closing the gap.

These and other features, advantages, and objects of the present invention will be further understood and appreciated by those skilled in the art by reference to the following specification, claims, and appended drawings.

BRIEF DESCRIPTION OF THE DRAWINGS

FIG. 3;

FIG. 4;

FIG. 5;

FIG. 9;

FIG. 11.

DETAILED DESCRIPTION

Figure 1:
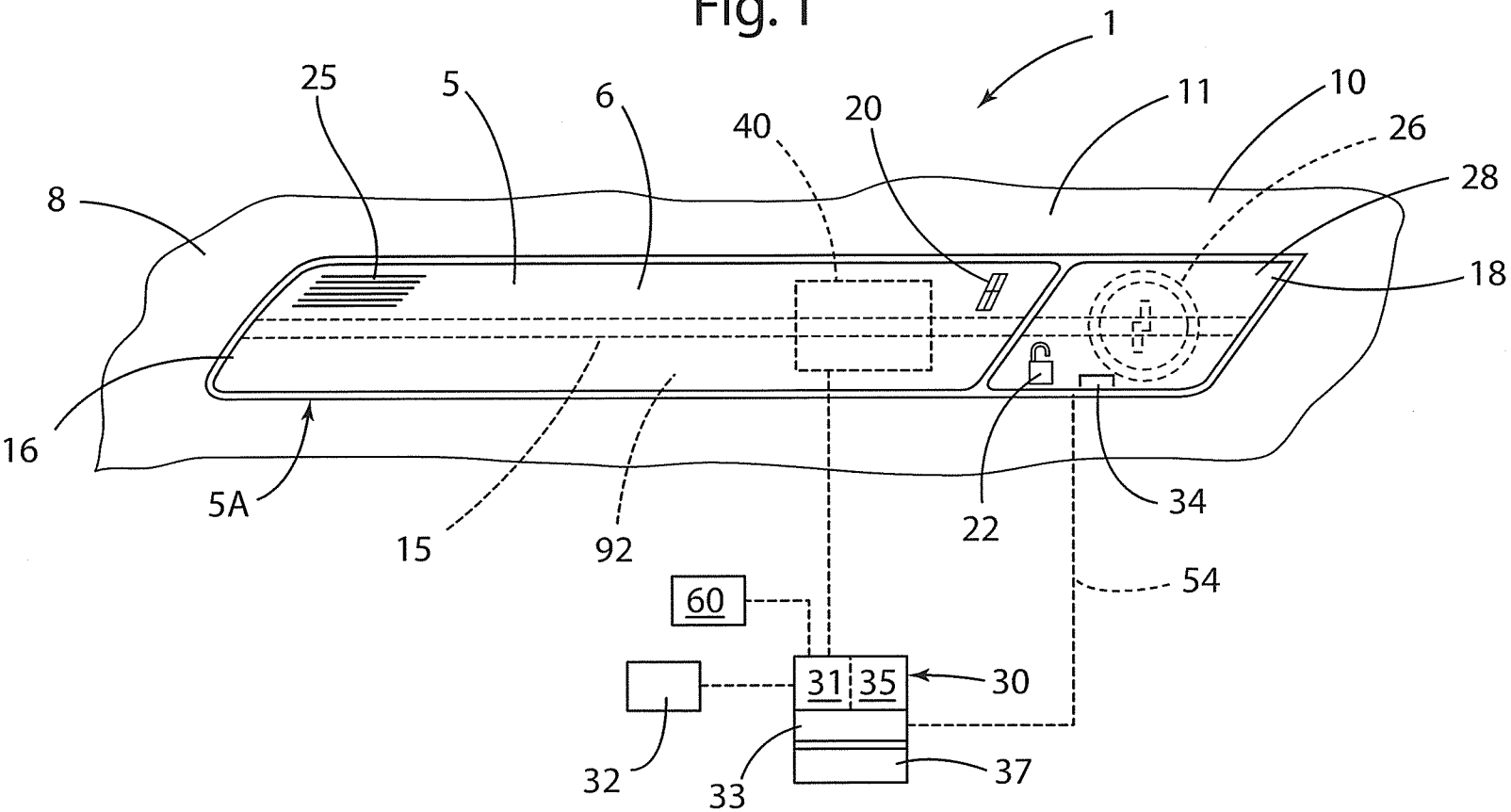
FIG. 1 is a partially fragmentary view of a deployable door handle according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawing, and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a deployable door handle assembly 1 according to one aspect of the present invention includes a handle member 5 that is movably mounted to a door structure 8 and selectively received in an opening 42 flush with the outer door surface. As discussed in more detail below, an electric motor 40 or other powered actuator provides for powered movement of the handle 5 into and out of opening 42. Electric motor 40 is operably connected to a powered latch assembly 30 and a power supply 32.

The powered latch assembly 30 may comprise a powered latch ("e-latch") as disclosed in U.S. Patent Application Publication Nos.: 20080250718, 20090160211, 20100235059, 20100235058, now issued as U.S. Pat. Nos. 7,926,385, 7,270,029, 8,451,087, 8,544,901 and 8,573,657 (hereinafter "Powered Latch Patents and Applications") the entire contents of which are incorporated by reference. As described in more detail in the Powered Latch Patents and Applications, the powered latch assembly/e-latch 30 includes a controller 31 and a powered actuator 35 that shifts a first mechanical latch member 33 to selectively latch and unlatch latch member 33 with a second latch member 37. Interconnection of first and second latch members 33 and 37 selectively retains the vehicle door in a closed or openable configuration or state. The e-latch assembly permits powered latch operation and conventional mechanical latch operation.

Door handle 5 includes an outer surface 6 that is generally flush with an outer surface 10 of the vehicle door when handle 5 is fully closed so it is positioned in opening 42. Outer surface 10 of the door may be a "Class A" surface that is painted to match the other portions of the vehicle body. The outer surface 6 of handle member 5 may be painted to match outer surface 10 of door structure 8, and may therefore have substantially the same appearance. Alternately, outer surface 10 may be a contrasting and/or decorative surface having a different color, and/or different texture or the like to provide a distinct appearance. For example, outer surface 10 may comprise a chrome accent/inlay or fully chrome surface. The contour of outer surface 6 of handle member 5 is substantially the same as, and flush with, the surrounding portions 11 of outer surface 10.

Figure 2:
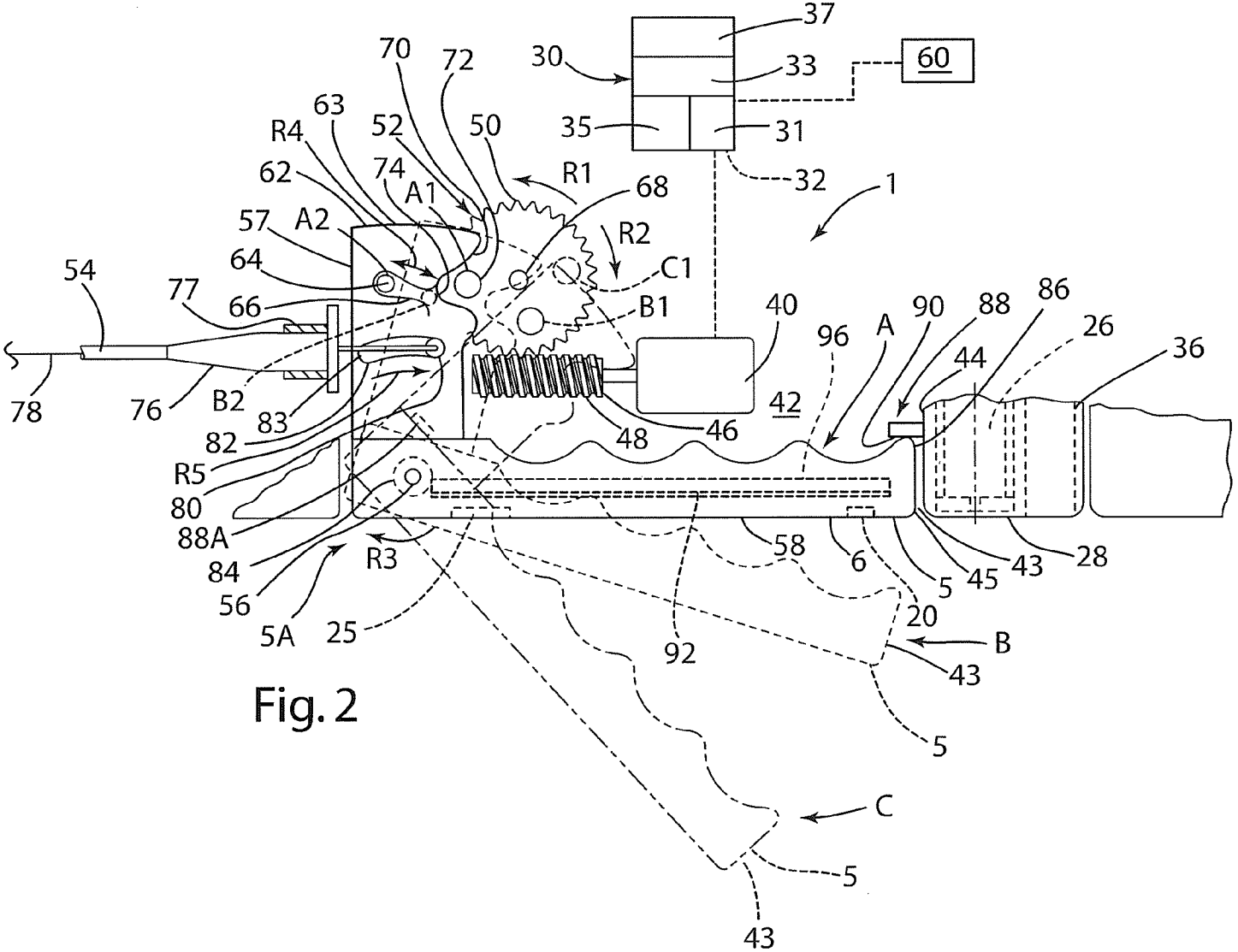
FIG. 2 is a partially fragmentary top plan view of a door handle according to one aspect of the present invention.

With further reference to FIG. 2, when handle member 5 is in a closed position "A," it is closely received in an opening/cavity space 42 formed in door structure 8. Edge surface 43 of handle member 5 has a contour that closely follows the contour of inwardly-facing surface 44 of door structure 8. This forms a small gap 45 that extends around handle member 5. The gap 45 is preferably a substantially uniform, small gap such that handle member 5 is flush with outer surface 10 of door structure 8 to reduce wind resistance, improve appearance, and other advantages associated with the flush handle assembly 1 of the present invention. Gap 45 may be very small, such as 0.010-0.050 inches (3 mm).

Handle assembly 1 may, optionally, include an illuminated chrome inlay 15 forming a horizontal band extending from a first end 16 of handle member 5 to a second end 18 of handle member 5. Inlay 15 may comprise an LED backlit chrome surface having LED light sources disposed behind a thin "one way" reflective layer or film. Handle member 5 may also include an illuminated symbol or design 20 corresponding to the vehicle make, model number, manufacturer's trademark, or the like. In use, symbol/light 20 may be turned on/off in response to various inputs. For example, symbol/light 20 may be configured to light up if predefined criteria are met, then slowly fade to off over a predetermined time interval (e.g. 5 or 10 seconds). Handle assembly 1 also includes an illuminated lock state indicator 22 that is selectively illuminated to indicate to a user whether or not the door is locked. In the illustrated example, lock state indicator 22 comprises a lighted padlock symbol. However, other designs or lettering or the like may also be utilized to indicate the state of the door lock. It will be understood that audio indicators, or other such indication devices may also be utilized to indicate the state of the door lock (i.e., whether or not the door is locked). The handle assembly 1 may also include a keyless entry lock switch 25. Keyless entry lock switch 25 may comprise a push button membrane type switch that may be manually actuated by a user in substantially the same manner as a lock button of a remote key fob for known powered door locks. After a user actuates lock switch 25, an antenna 92 (FIG. 4A) and controller 31 senses the presence of a fob and checks to determine if the user is authorized. It will be understood that although the illuminated symbol 20, lock state indicator 22, and keyless entry indicator 25 are preferably mounted on handle member 5, one or more of these components could be mounted to door structure 8 adjacent handle member 5, or other suitable location.

The deployable door handle assembly 1 may also include a conventional lock cylinder 26 (see also FIG. 2) that is positioned behind a removable bezel/cover plate 28. Lock cylinder 26 is normally positioned behind fixed bezel or cover plate 28, and is therefore not normally visible from the exterior of the vehicle. However, the bezel/cover plate 28 can be removed to provide access to the lock cylinder 26 in the event the powered latch 30 becomes inoperable due to a loss of electrical power or other such situation. A small slot 34 or other such feature may be included in bezel/cover plate 28. In use, a conventional key, screw driver, or the like may be inserted into slot 34 to pry bezel/cover plate 28 loose/off. The bezel/cover plate 28 may have a snap fit connection to door handle structure/chassis/housing 36, or it may be connected utilizing an adhesive or other suitable material. A snap fit connector could include a rib (not shown) that deflects under pressure from a key blade to allow the bezel/cover plate 28 to disengage from handle chassis 36.

Handle assembly 1 includes a powered actuator (e.g. electric motor 40) that moves handle member 5 from a closed position "A" to a partially open or "presented" position "B." A powered actuator such as electric motor 40 drives a worm gear 46 having spiral gear teeth 48 that engage radial gear teeth 50 of a worm wheel/gear 52. In use, electric motor 40 first shifts handle member 5 from the fully closed position A to the presented position B. After the handle member 5 is shifted to the presented position B by electric motor 40, a user can then grasp handle member 5 and rotate the handle member 5 from the presented position B to a fully deployed position "C." Movement of the handle member 5 from position B to position C causes movement of a cable 54 that is mechanically connected to mechanical latch 33 to thereby unlatch the latch mechanism 30 in a conventional manner. Pivot or hinge 56 may comprise a conventional pin, shaft, hinge, or other suitable structure.

Advantageously, the worm gear 46 is "self locking," and includes slanted flutes on gears 48. Because the worm gear 46 is self locking, an outward force applied to handle 5 cannot cause cable 54 to shift if handle member 5 is in the retracted or closed position "A." Specifically, an inertial force acting outwardly on handle member 5 may cause worm gear 46 to create a force on worm wheel/gear 52. However, worm wheel/gear 52 cannot turn due to its engagement with worm gear 46. Thus, worm gear 46 and worm wheel/gear 52 thereby form a lock that prevents rotation of worm/wheel gear 52 if a force is applied to handle member 5, but permits movement of handle member 5 upon application of a rotational force to the worm gear 46 by electric motor 40.

Handle member 5 comprises a bell crank having an inwardly extending portion 57 and an elongated outer portion 58 that together form an L-shape in plan view as shown in FIG. 2. End 62 of inwardly extending portion 57 has an arcuate surface 63 having a uniform radius relative to pivot 56. A post 64 is fixed to inwardly extending portion 57 of handle member 5, and a detent spring 66 is mounted to the door structure 8. Inwardly extending portion 57 of handle member 5 includes a groove or recess 70 that is configured to engage a post 72 on gear 52 to thereby rotate handle member 5 upon rotation of worm wheel/gear 52. Post 72 is spaced apart from center axis or shaft 68 of worm wheel/gear 52, and moves with the gear 52 as gear 52 rotates.

As discussed above, actuation of electric motor 40 causes worm wheel/gear 52 to rotate. If handle member 5 is to be shifted from position A to position B, electric motor 40 is actuated to rotate worm wheel/gear 52 in the direction of arrow "R1." This, in turn, causes post 72 on worm wheel/gear 52 to contact and engage arcuate or smoothly curved notch 70 of inwardly extending portion 57 of handle member 5. This, in turn, generates a force acting on handle member 5 tending to rotate the handle member 5 from position A to position B.

Thus, if certain operating conditions (discussed in more detail below) are present, electric motor 40 can be actuated to shift handle member 5 from position A to position B without actuating cable 78.

Upon receiving a signal from controller 31, electric motor 40 is actuated to rotate in either a forward or reverse direction, causing worm wheel/gear 52 to rotate in a first direction "R1" or "R2," respectively. Handle member 5 is initially in the fully retracted or closed position "A." When handle member 5 is in position A, second post 74 on handle member 5 engages a detent spring 66 (fixed to the handle structure) to thereby create a detent tending to retain post 64 in the position "A2." This, in turn, creates a detent tending to retain handle member 5 in the closed position A. As worm wheel/gear 52 rotates in the direction R1, post 72 on worm wheel/gear 52 engages recess 70 of handle member 5, causing handle member 5 to rotates about axis 56 in the direction of the arrow "R3." Thus, the post 72 moves from the position A1 to the position B1 and causes handle member 5 to shift from position A to the presented position B. It will be understood that position B1 of post 72 is only instantaneous. The worm wheel/gear 52 rotates until post 72 stops at position C1 (during open cycle), and this allows 57 to rotate past the post 72. If post 72 stays at B1, there will be a clash condition between 57 and 72 as the handle is operated from B to C (manually) to release the latch. Then, during power close/retract cycle, post 72 rotates from C1 to B1, then engages into 70 and drives the handle to back to home position A.

Cable 54 includes an outer sheath 76 having a fitting 77 connected thereto. Fitting 77 can be mounted to the handle structure 'x' in a known manner. Cable 54 also includes a flexible steel wire (stranded) inner cable 78 that mechanically interconnects handle member 5 to the mechanical latch 33 (shown schematically in FIG. 1). An end fitting 80 is fixed to inner cable member 78. End fitting 80 is slidably received in an arcuate slot 82 formed in inwardly extending portion 57 of handle member 5 to form a lost motion connection. As the handle member 5 shifts from position A to position B, end fitting 80 of cable 54 slides along arcuate slot 82 such that no tension is placed on inner cable 78 by handle 5 as handle 5 moves from position A to position B. The lost motion connection ensures that movement of handle member 5 between positions A and B does not actuate or pull cable member 78.

Once the handle member 5 reaches position B, further rotation of handle member 5 towards the fully extended position C causes post 72 of worm wheel/gear 52 to disengage from arcuate notch 70 of inwardly extending portion 57 of handle member 5. In operation, the electric motor 40 first shifts handle member 5 from position A to position B. A user can then grasp handle 5 and rotate it from position B to position C. As handle member 5 rotates from position B to position C, end fitting 80 contacts end 83 of arcuate slot 82, thereby tensioning and moving cable 78 to thereby actuate mechanical latch 33. Electric motor 40 is configured to rotate worm wheel/gear 52 such that post 72 moves from position A1 to position B1, followed immediately by movement of post 72 to position C1. Thus, worm/wheel gear 52 rotates "forward" (counterclockwise in FIG. 2) 180° to shift handle member 5 from position A to position B. This shifts post 72 to a position that is "completely" disengaged from handle member 5 directly adjacent arcuate surface 63 such that manual rotation of handle member 5 from position B to position C is not impeded or otherwise affected by post 72 moving along arcuate surface 63 of inwardly extending portion 57 of handle member 5. It is noted that arc shaped surface 63 is centered about pivot 84 of handle 5. This allows the arc shape 63 to rotate about the handle pivot 84 and to clear post 72 on gear 52 while the handle 5 articulates from position B to C and back from C to B.

Handle assembly 1 may include a torsion spring 84 that biases handle member 5 from position C towards closed position A. Thus, after a user pulls handle member 5 from position B to position C to open the vehicle door, a user then releases handle member 5, and torsion spring 84 causes handle member 5 to rotate from position C to position A. End 86 of handle member 5 may be configured to contact a stop 88 to thereby limit inward rotation of handle member 5. Stop 88 may comprise a resilient surface 90 that reduces snap back noise and vibration as handle member 5 shifts to the closed position A. Stop 88 is a dual purpose feature, namely, a snap back damper and also a contact switch that monitors the home position of the handle 5 (i.e. position A). Also, as discussed above, detent spring 66 and post 64 control the handle position B, and a full open stop 88A at handle position C to prevent a user from over-traveling the handle 5 and damaging it or other structures/features. The full travel stop 88A of the handle 5 is designed such that the handle 5 stops before the latch outside release lever reaches its full travel. This is a fail-safe feature that prevents handle 5 from damaging the latch during an over-travel situation. Electric motor 40 may then be rotated to shift gear 52 from position C1 to position A1. Alternately, electric motor 40 may be controlled in such a way that it rotates from position C1 to position A1 (as shown by arrow R2) before handle member 5 reaches position A, thereby causing post 72 to contact groove or recess 70 in inwardly extending portion 57 of handle member 5 to thereby provide powered rotation of handle member 5 to the fully closed position A.

Figures 3, 3A:
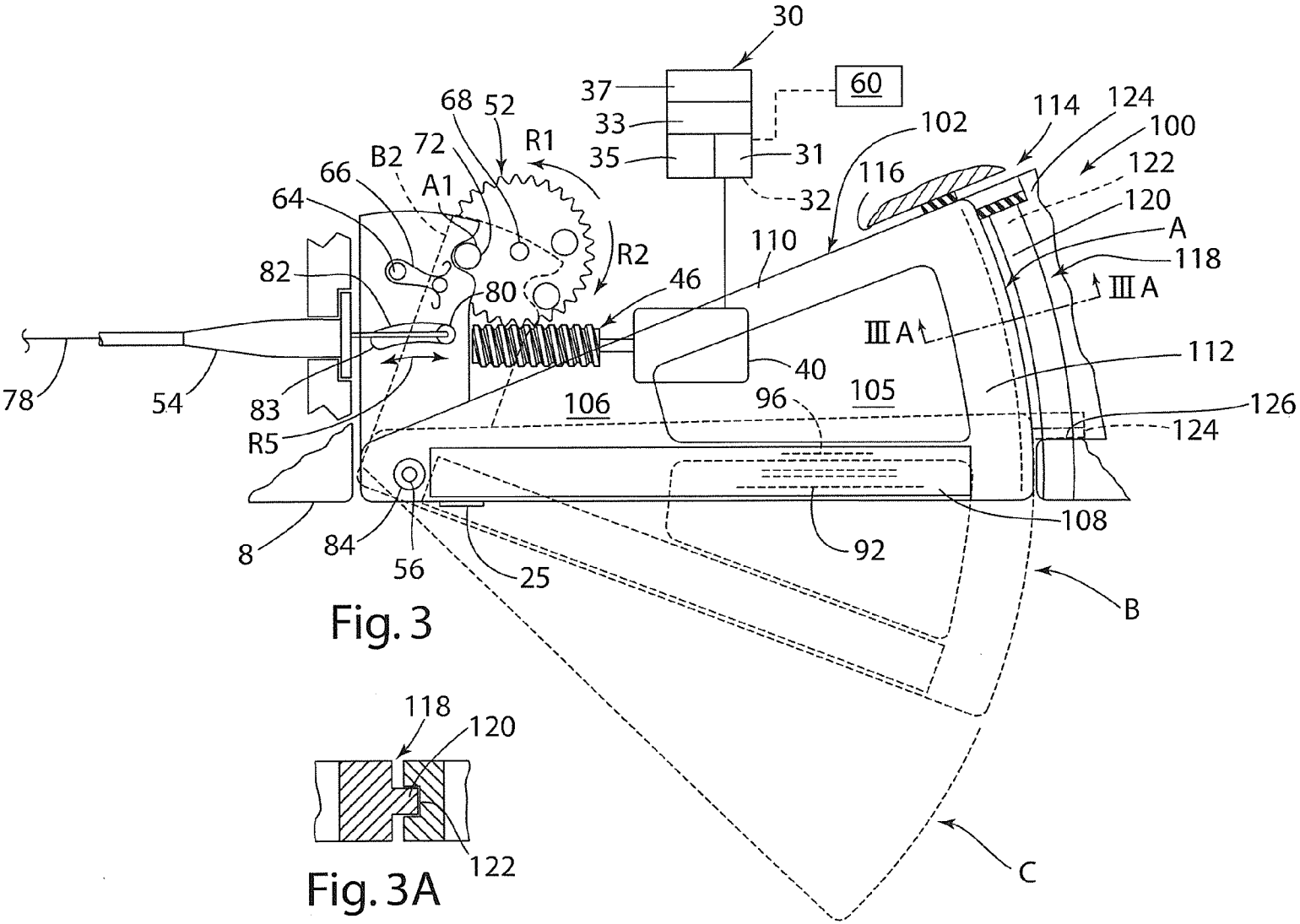
FIG. 3 is a partially fragmentary top plan view of a door handle according to another aspect of the present invention.
FIG. 3A is a cross-sectional view of a portion of the door handle of FIG. 3 taken along the line IIIA-IIIA.

As discussed in more detail below, controllers 31 and/or 60 can be configured to utilize inputs from sensor 91 and/or other inputs such as antenna 92. Also, a sensor at pivot 56 or other suitable location may be utilized to enable controllers 31 and/or 60 to determine the position of handle member 5. Also, sensors at inner and outer stops may be utilized to generate a signal indicating that handle member 5 is either fully open or fully closed to control operation of electric motor 40. With further reference to FIG. 3, a deployable door handle assembly 100 according to another aspect of the present invention includes an electric motor 40 driving a worm gear 46 and gear 52. Gear 52 includes a post 72. These components/features are substantially the same as the corresponding components described in more detail above in connection with the deployable door handle assembly 1 of FIGS. 1 and 2. Deployable handle assembly 100 also includes a cable 54 having an end fitting 80 that are substantially the same as the corresponding components of handle assembly 1 of FIG. 2. The components of FIG. 3 marked with the same numbers as the door handle assembly 1 of FIG. 2 are substantially identical thereto, and will not therefore be described in detail in connection with FIG. 3.

In contrast to the handle assembly 1 of FIG. 2, the handle 102 of FIG. 3 includes a central opening 105 formed by a wedge-shaped center portion 106, inner and outer radially extending portions 108 and 110, respectively, and an outer arcuate portion 112. A stop 114 includes a resilient pad 116 that functions as snap back damper and a contact switch to monitor home position of the handle 5. Stop 114 functions in substantially the same way as stop 88 described in more detail above in connection with FIG. 2.

Door handle member 102 also includes a slide assembly 118 (see also FIG. 3A) that supports handle member 102 during movement between positions A, B, and C. Slide assembly 118 may comprise an outwardly extending arcuate tongue member 120 that is closely received in an arcuate channel or groove 122. Channel 122 may comprise a low friction inner surface, and/or outwardly extending portion 120 may comprise a low friction surface. For example, one of extension 120 and channel 122 may be made from steel or other metal, and the other of extension 120 and channel 122 may be made of Teflon or other low friction polymer material. Also, a damper (not shown) may be utilized to interconnect the handle member 102 to the door structure 8 and thereby control the velocity of handle member 102.

Slide assembly 118 may include an outer stop comprising a second resilient member 124 that contacts an inner surface 126 when handle member 102 is shifted to the open position C to thereby prevent outward rotation of handle member 102 beyond position C.

Handle system 100 May also include a lock cylinder 26 that provides a mechanical backup in the event the electrical motor 40 does not work due to a power failure or the like. A cover plate 28 (FIG. 1) can be removed by inserting a key or other object into slot 34 to thereby pry the cover plate 28 loose. A conventional key is then inserted into lock cylinder 26. Rotation of the key in a clockwise direction shifts a conventional mechanical cable or a rod (not shown) having a construction that is substantially similar to the cable 54.

Figure 4:
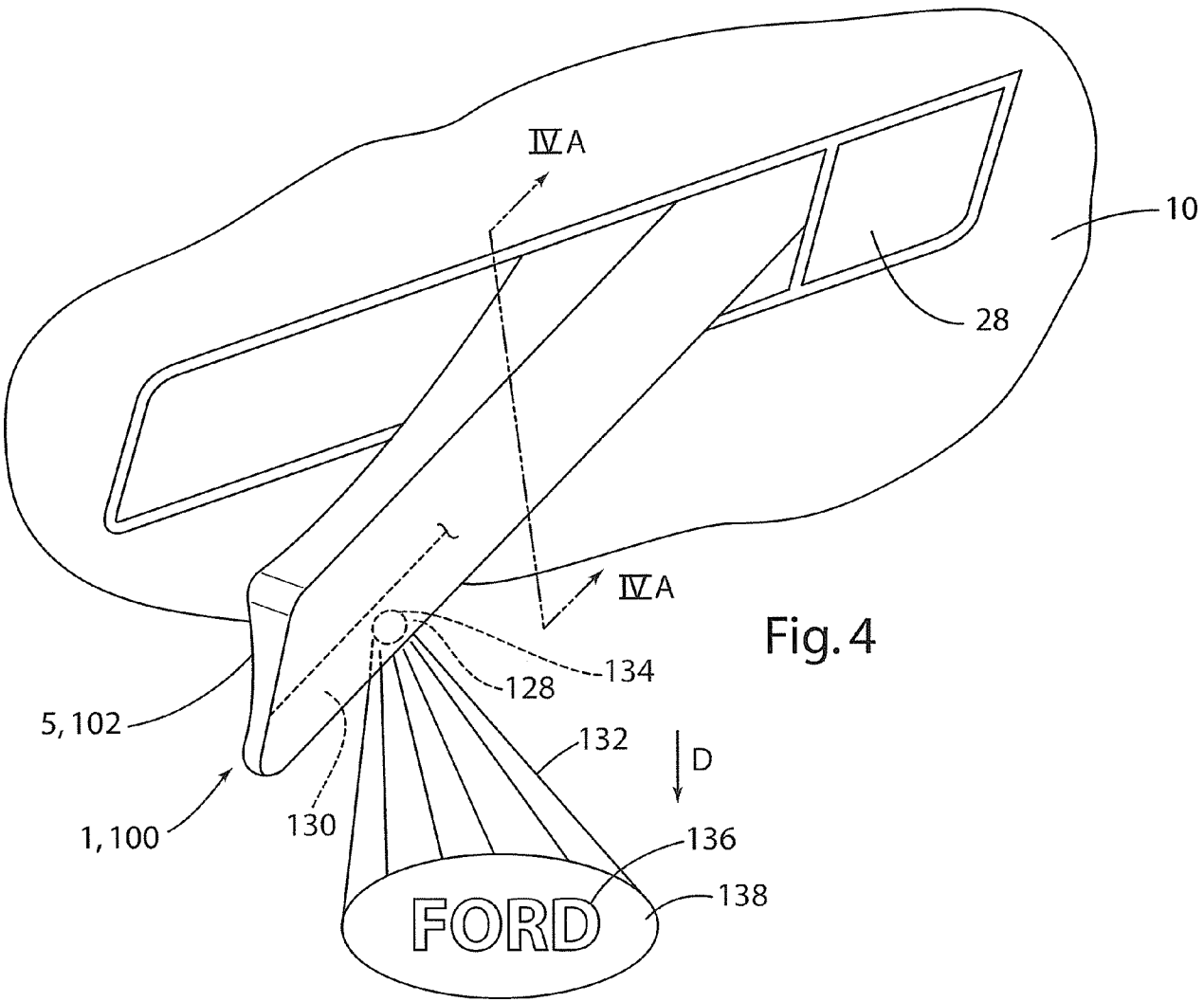
FIG. 4 is a partially fragmentary isometric view of a deployable, lighted, door handle according to another aspect of the present invention.

With further reference to FIG. 4, door handle assembly 1 or 100 may include an LED light mounted to a lower edge portion 130 of handle member 5 or handle member 102. Light 132 from LED 128 shines downwardly in the direction of the arrow "D" and onto the ground adjacent the vehicle to form a light pattern 136 on the ground 138 when handle member 5 is in an open or partially open position. The lower edge portion 130 of handle 5 LED light source 128 may be formed from a transparent or translucent material forming a lens 134. The material is painted in a color that may match the vehicle exterior body surface. A laser can be utilized to etch the lens to selectively remove the paint, whereby the lens forms a light pattern 136 forming a brand logo or the like. LED 128 may be configured such that it is turned off and/or blocked when handle member 5 is in a closed position, such that LED 128 only illuminates the ground when handle member 5 is not in the fully closed position.

Figure 4A:
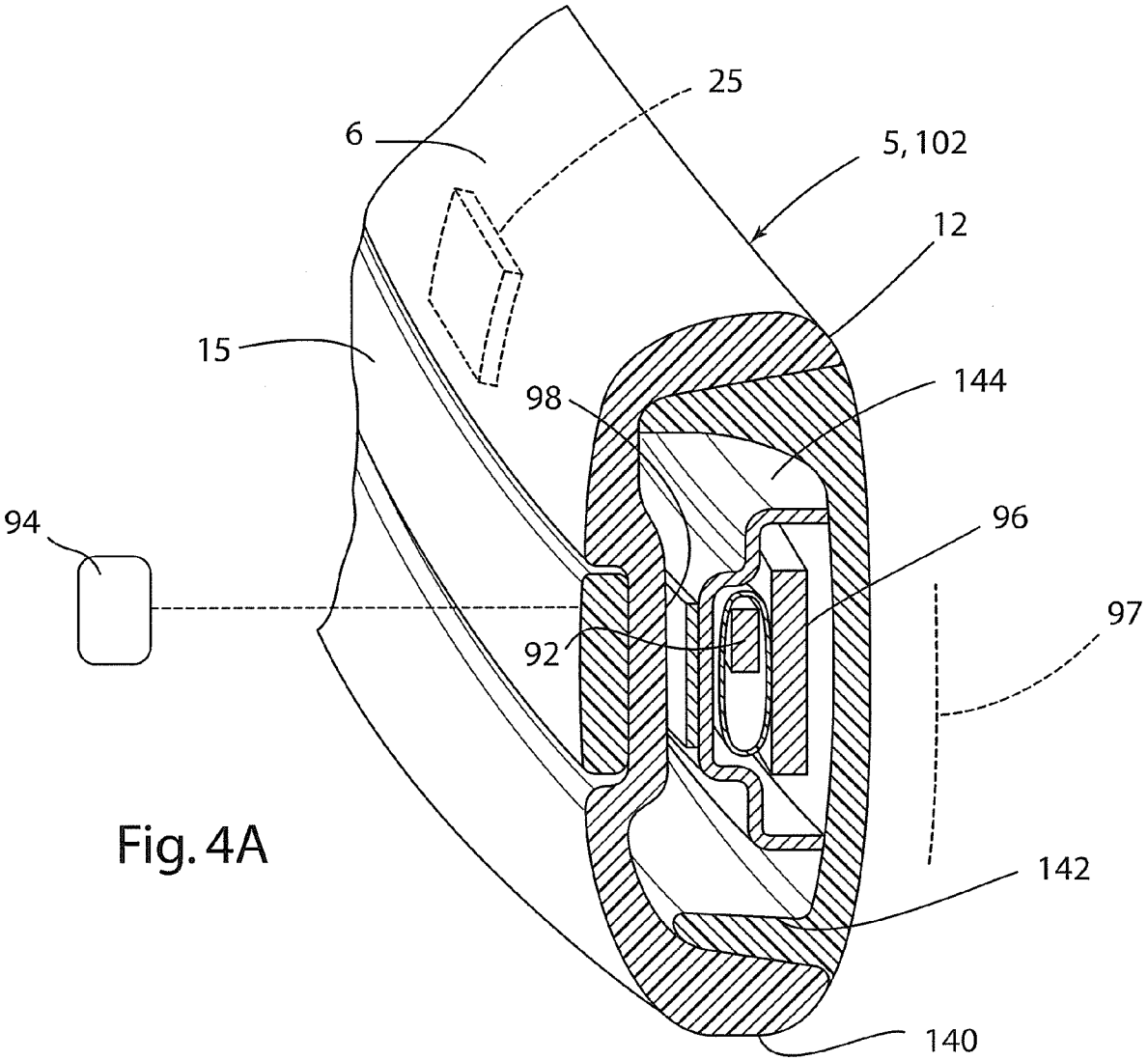
FIG. 4A is a cross-sectional view of the door handle of FIG. 4 taken along the line IVA-IVA.

With reference to FIG. 4A, door handle member 5 (or any other handle member described herein) may include an outer structure 140 and an inner structure 142. The handle 5 may include an illuminated chrome inlay 15 and a "class A" surface 6 that generally faces outwardly away from the vehicle. An inner surface 12 generally faces towards a vehicle. The door handle 5 may include an internal antenna 92 disposed in an elongated internal space 144. Antenna 92 faces outwardly, towards the outer surface 6 of handle member 5. Antenna 92 may be of a known design that communicates with a keyless entry fob 94. Antenna 92 is operably connected to controller 31 and/or body control module 60 (FIGS. 1 and 2). Controller 31 and/or controller 60 authenticate the user identity based on the keyless entry fob 94. The specifics of how and when, and under what conditions the handle is presented/deployed from position A to position B can be configured by a user to suit their individual requirements.

An unlock sensor 96 is also disposed in internal cavity 144 of handle member 5. Unlock sensor 96 faces the inner or "B" surface 12 of handle member 5. In use, sensor 96 detects the presence of a user's fingers or hand 90 if the user's fingers 97 are positioned adjacent B or inner surface 12. Sensor 96 may comprise a piezoelectric (i.e. touch sensitive) sensor, or it may comprise a capacitive (proximity) sensor that is triggered if an object is within a predefined range. A locking sensor 25 is positioned adjacent a forward end 5A (FIGS. 1 and 2) of handle member 5 whereby it can be pressed/actuated by a user to lock/unlock the vehicle door.

In use, as a user approaches the vehicle, and comes within a predefined range (e.g. 1-2 meters) from the vehicle, the passive entry passive start (PEPS) module comprising the antenna 92, unlock sensor 96, and lock sensor 25 communicates with keyless entry fob 94. The controllers 31 and/or 60 authenticate the user identity based on the keyless entry fob 94. The conditions required to cause actuation of electric motor 40 to shift handle 5 (or 102) can be set to meet a particular users' requirements. If these conditions are met, electric motor 40 is actuated, and handle member 5 is shifted from position A to position B. The user then grasps the handle 5, and unlock sensor 96 generates a signal indicating that the users' hand is present. If sensor 96 does not generate a signal indicating that a users' hand is present, powered latch assembly 30 will not permit the latch 33 to shift to an unlatched position (for e-latch and unlock position for mechanical latch), even if tension is applied to inner cable 78. However, if sensor 96 determines that a users' fingers 97 are present, powered latch assembly 30 changes to a "unlatchable" state if it is an e-latch, but to an unlock state if it is a mechanical latch.

If the system has shifted the powered latch assembly 30 to an unlatchable state (for an e-latch and unlock state for a mechanical latch), a user can then continue to pull on handle 5 to shift cable 78 and thereby shift latch 33 to an unlatched position. The user then lets go of the handle member 5, and torsion spring 56 causes the handle member 5 to return to the position B and then motor powers it back to handle position A. Once the user gets into the vehicle and the controllers 31 and/or 60 (and antenna 92) detect the keyless entry fob inside the vehicle, controllers 31 and/or 60 cause the powered latch assembly 30 to shift to the latched position if latch assembly 30 comprises an e-latch. If a mechanical latch is utilized, the latch is moved to a locked state once the vehicle reaches a predetermined speed, (e.g. 12 Km/hr). The door ajar signal and light are also closed. When the ignition is on, the controllers 31 and/or 60 send a signal to electric motor 40 to rotate in the closing direction "R1" (FIGS. 2 and 3), and the gears 46 and 52 ensure that the handle member 5 is driven to the fully closed position A. As gear 52 rotates, post 72 rotates to position A1 (FIG. 2), thus completing a full entry-exit cycle utilizing a keyless entry feature or configuration.

If the vehicle does not have a keyless entry feature, the key fob 94 could comprise a conventional remote key fob with push buttons or other user input features. Also, lock switch or sensor 25 may be configured to provide a push button lock/unlock function. Upon receiving an unlock signal from sensor 25 or a remote fob, electric motor 40 can be actuated to shift handle 5 from position A to position B. The conditions under which the handle shifts from position A to position B can be varied by a user. Specifically, the user can select different operating modes or conditions whereby controllers 31 and/or 60 are configured to cause the handle member 5 to deploy from position A to position B.

For example, the system could be configured to turn the lights on and shift the drivers' door handle 5 from position A to position B before the user gets to the vehicle. Also, a user may select an operating mode wherein handle 5 is deployed from position A to position B if the user touches the handle or moves their hand on the handle after they reach the vehicle. This mode of operation prevents inadvertent or unwanted shifting of the handle from position A to position B if a user walks by the vehicle while carrying fob 94 when the vehicle is in the garage, outside, or the like, and the user/owner is engaging in a different activity such as mowing the lawn.

This flexibility in the design utilizing programmable software allows users to configure their individual entry/exit experience to their liking, life-style needs, and risk tolerance. Some users would not want their handle to deploy each time they approach the vehicle, while others like the convenience of the handle in the presented/deployed position ready for them to use (e.g. a cold winter evening after work).

Under such conditions some users would not want to wait for the handle 5 to shift to position B because it would delay their entry into the vehicle.

Controller 60 may include an antenna and/or other features that enable it to communicate with a cell phone. The user can send a command to their vehicle utilizing their cell phone to request to get ready for their arrival at a given time (e.g. 6 p.m.). Their vehicle would then go into a preparation mode wherein all critical systems are ready for use. For example, interior lights could be turned on, a heater in the seat could be actuated, and the vehicle climate control could be actuated. The controller 60 then sends a signal to a user indicating it has completed its preparation mode for a 6 p.m. arrival. However, the controllers 31 and/or 60 are configured such that handle 5 is not deployed to the presented position B from position A until it actually senses the presence of entry fob 94 within the predefined range (e.g. 1-3 meters). In this way, the vehicle "knows" that the user intends to arrive and use the vehicle at a scheduled time, and it can present the handle once the user is within the 1-3 meter range.

Figures 5, 5A:
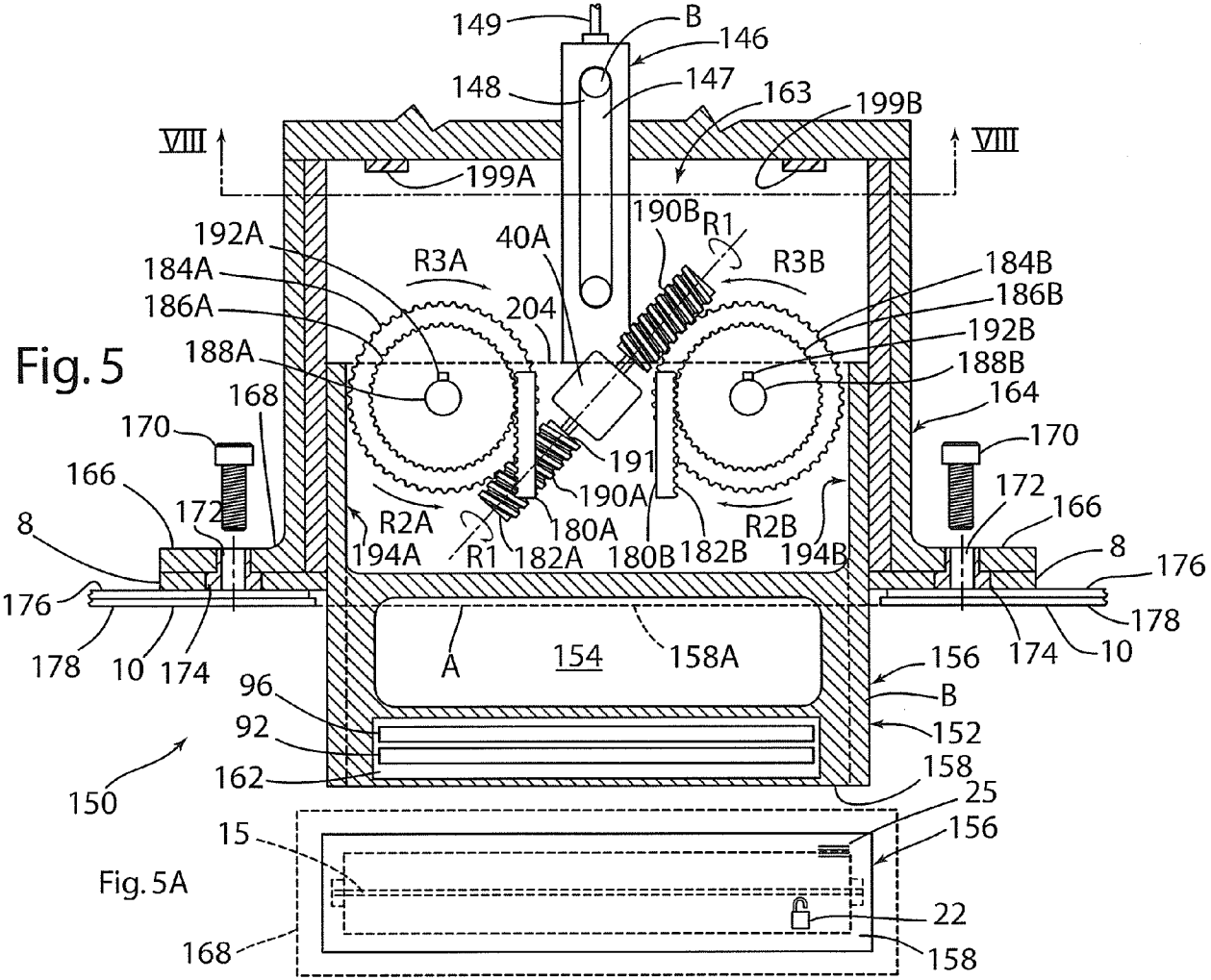
FIG. 5 is a cross-sectional plan view of a deployable door handle according to another aspect of the present invention.

With further reference to FIG. 5, a deployable handle system 150 according to another aspect of the present invention includes a handle member 152 that is driven linearly between a fully retracted position A and a deployed position B by an electric motor 40A. Handle member 152 defines an opening 154 that is elongated to form a loop type grip for a user. The handle member 152 includes a body 156 (see also FIG. 5A) that may include an illuminated chrome inlay or strip 15, and a locked state indicator that may comprise a lighted symbol such as a padlock or the like (e.g. indicated 22, FIG. 1). Handle body 156 may include a space or cavity 162, and an antenna 92 and unlock sensor 96 disposed in cavity 162. The antenna 92 and sensor 96 may operate in substantially the same manner as described above. Electric motor 40A may be operably interconnected to controllers such as controllers 31 and 60 (FIG. 1) and a powered latch as also described in more detail above. A linear sensor provides data to controllers 31 and/or 60 such that the controller(s) can determine the position of handle member 152.

Referring again to FIG. 5, handle body 156 may be slidably mounted in a housing 164. Housing 164 includes a pair of flanges 166 that may extend around a periphery 168 of a housing 164. Threaded fasteners 170 are received in openings 172 through flanges 166, and the threaded fasteners 170 are threadably engaged with corresponding threaded nuts 174 connected to door structure 8. A resilient gasket 176 may be disposed between outer sheet metal skin 178 and the portion of door structure 8 that is utilized to secure housing 164 to door structure 8 to prevent air, water and dust intrusion.

Figure 8:
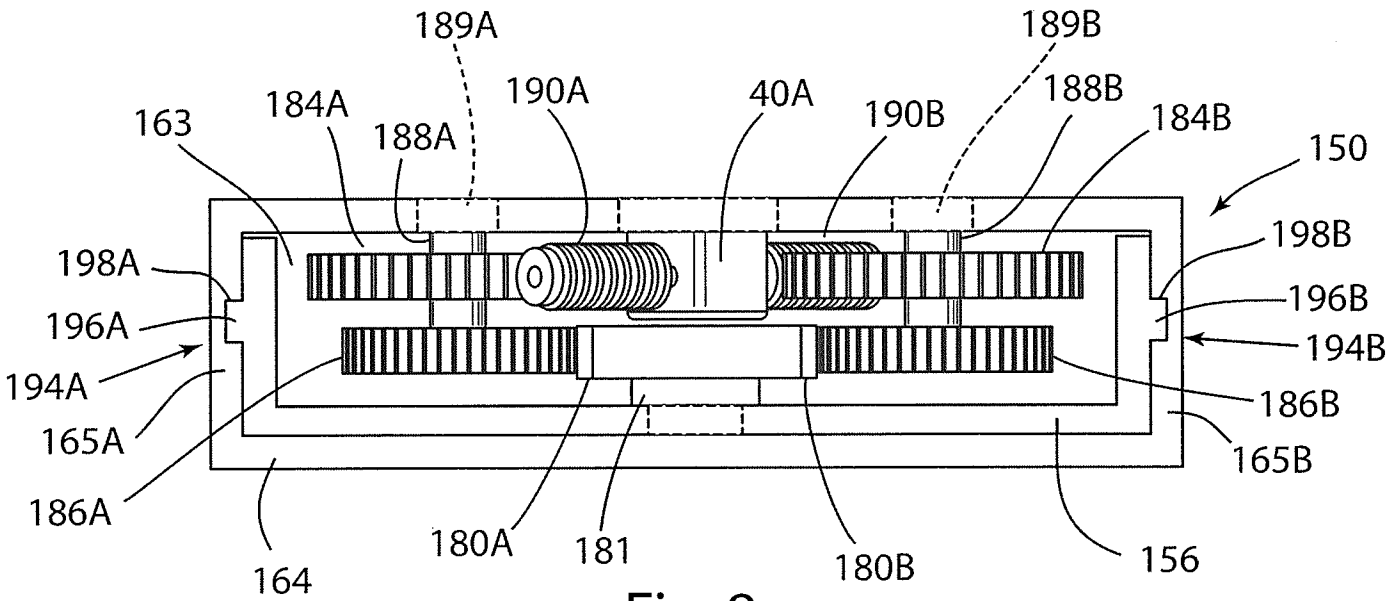
FIG. 8 is a cross-sectional view of the door handle of FIGS. 5 and 6 taken along the line VII-VII.

Handle member 152 may be slidably mounted to housing 164 by linear slide assemblies 194A and 194B. With further reference to FIG. 8, slide assemblies 194 may comprise outwardly-protruding linear tongues 196A and 196B of handle body 156 that are slidably received in channels 198A and 198B of sidewalls 165A and 165B of housing 164. One or both of the protrusions 196 and channel 198 may comprise a low friction material such as Teflon to facilitate sliding of handle member 152 relative to housing 164. A damper and/or spring may be utilized to control movement of handle member 152 for a controlled stop at both positions A (home) and B (deployed).

A pair of rack members 180A and 180B include outwardly facing teeth 182A and 182B. The racks 180A and 180B are fixed or integral with handle body 156 of handle member 152, and therefore translate with handle member 152. A pair of larger diameter spur gears 184A and 184*b* are rotatably mounted to pins or shafts 188A and 188B, respectively. The gears 184 and 186 may be fixed to pins 188 by keys 192A and 192B. The vertical stack of two gears (i.e. 184 and 186) provides for speed reduction from the electric motor 40A down to the rack (180A, 180B) to achieve a high torque and controlled linear slower motion of the handle/rack system. Motor 40A rotates at a very high rpm (1000+) and worm gears 190A and 190B also rotate at the high rpm. This rpm is reduced via a gear ratio which reduces speed from worms 190A and 190B via the larger diameter gear 184, and also increases torque. Since smaller diameter gear 186 is also on the same shaft as the larger gear 184, smaller gear 186 will rotate at the same angular speed and torque. Since Torque=Force×D (where D is distance which in this case the radius of the gear), the force generated by the smaller diameter gear 186 is higher than the force generated by the large diameter gear 184, because "D" is smaller on smaller gear D, the Torque on smaller diameter gear 186 is the same as the torque on the larger gear because they are pinned to the same shaft but the Force generated by the smaller diameter gear 186 is large than larger diameter 184. The smaller diameter gears 186 mesh with the racks 180A and 180B and transfer the large force to the handle body. Thus, this configuration addresses the high force required to overcome ice formation over the flush handle and between the handle and the sheetmetal surrounding the handle.

It will be understood that worms 190A and 190B rotate in the same direction when viewed from plan view or a horizontal sectional view. However, it is important to note that if the motor shaft rotates in a CCW direction (as observed from the LH side in FIG. 5) and the worm gears have LH flutes on the LH side (190A) and RH flutes on the RH side (190B), then if observed from the RH side worm 190B would be rotating in CW direction (due to the different observation viewpoints.) Pins or shafts 188A and 188B are rotatably mounted to housing 164 by bearings 189A and 189B (see also FIG. 8). As shown in FIG. 8, housing 164 includes opposite sidewalls 165, and upper and lower walls 167 that together form a shape as generally rectangular in cross section, and an internal space or cavity 163. A pair of oppositely-spiraled worm gears 190A and 190B engage spur gears 184A and 184B, respectively. The worm gears 190A and 190B are driven by an electric motor 40A in the same rotational direction "R1." A pair of smaller diameter gears 186A and 186B engage teeth 182A, 182B of racks 180A and 180B, respectively. With reference to FIG. 8, racks 180A and 180B may be rigidly secured to handle body 156 by a mounting structure 181 or they can be integral/molded into the handle member 152.

When handle member 152 is in the retracted position, outer or front face 158 of handle member 152 is flush with outer surface 10 of the vehicle door as shown by the dashed line 158A (FIG. 5). Upon actuation of electric motor 40A, the worm gears 190A and 190B both rotate in the direction R1, causing gears 184 and 186 to rotate in opposite directions as shown by arrows "R3A" and "R3B." Worm gears 190A and 190B are both fixed to the same shaft 191 of electric motor 40A, and the gears 184A and 184B are therefore driven at the same angular velocity, but in opposite rotational directions R3A and R3B. It is noted that the worm gears are fluted in opposite directions (e.g. 190A is LH fluted and 190B is RH fluted) which is what causes gears 184A and 184B to rotate in opposite directions. Smaller diameter gears 186A and 186B are also driven at the same angular velocity, but in opposite angular directions (i.e. clockwise and counterclockwise in FIG. 5) upon actuation of electric motor 40A. Gears 186 engage/mesh with the linear racks 180A and 180B, such that rotation of gears 186A and 186B causes the handle member 152 to travel linearly outboard from fully retracted/home position A to deployed position B during open cycle and the opposite during close cycle.

However, because of the geometry of the gear teeth, a force input to handle member 152 cannot cause gears 184 and 186 to rotate worm gears 190A and 190B. Thus, in the event an inertial force (or other force) is applied to the handle member 152, handle member 152 cannot shift from the fully retracted position A to the deployed position B. However, handle member 152 can be shifted from the deployed position B to the retracted position A by actuation of electric motor 40A in an opposite direction relative to the direction required to shift handle member 152 from position A to position B. However, handle member 152 can be shifted from the deployed position B to the retracted position A by actuation of electric motor 40A in an opposite direction relative to the direction required to shift handle member 152 from position A to position B.

Referring again to FIG. 5, a pair of resilient stop members 200A and 200B may be mounted to rear wall 202 of housing 164. In use, rear surface 204 of handle member body 156 may contact stops 200A and 200B to prevent movement of outer side surface 158 inwardly beyond outer surface 10 of the vehicle door and thereby maintain a flush condition to the door outer panel. A sensor may be operably connected to handle member 152 to provide an indication to controllers 31 and/or 60 when handle member 152 is in the fully retracted position.

Figure 6:
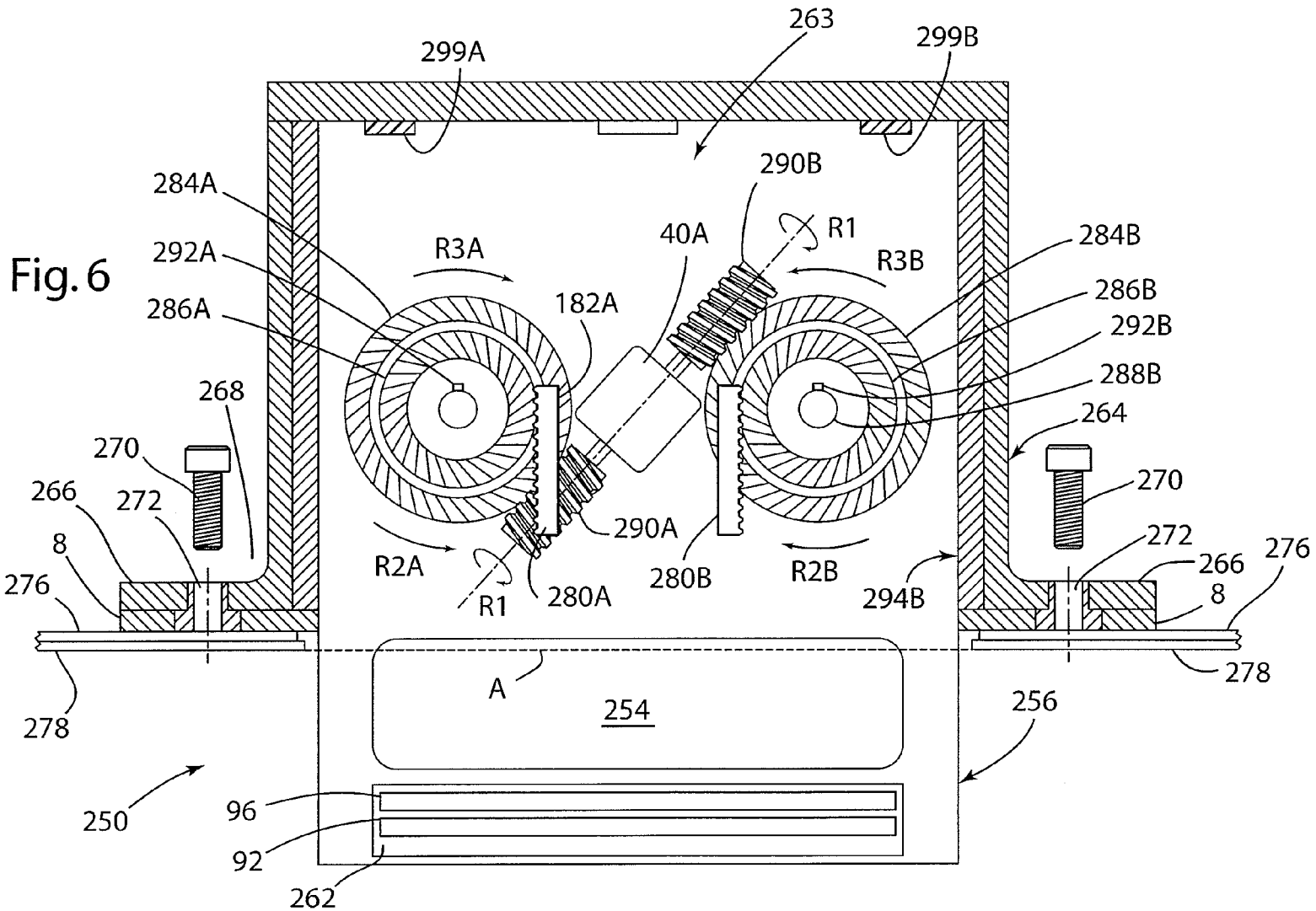
FIG. 6 is a cross-sectional plan view of a deployable door handle according to another aspect of the present invention.

With further reference to FIG. 6, a sliding deployable handle assembly 250 according to another aspect of the present invention includes many components that are substantially the same as the handle assembly 150. However, gears 290A and 290B, 284A and 284B, 286A and 286B, and racks 280A and 280B comprise helical gears that provide smooth operation and other advantages relative to straight gears as disclosed in FIG. 5. The other components of sliding handle assembly 250 are substantially the same as the corresponding components of sliding handle assembly 150 of FIG. 5, and the corresponding components in FIG. 6 are therefore numbered the same as in FIG. 5, except that "100" has been added to each part number. Handle assembly 250 may include position and stop sensors as described in connection with handle assembly 150.

Figure 7:
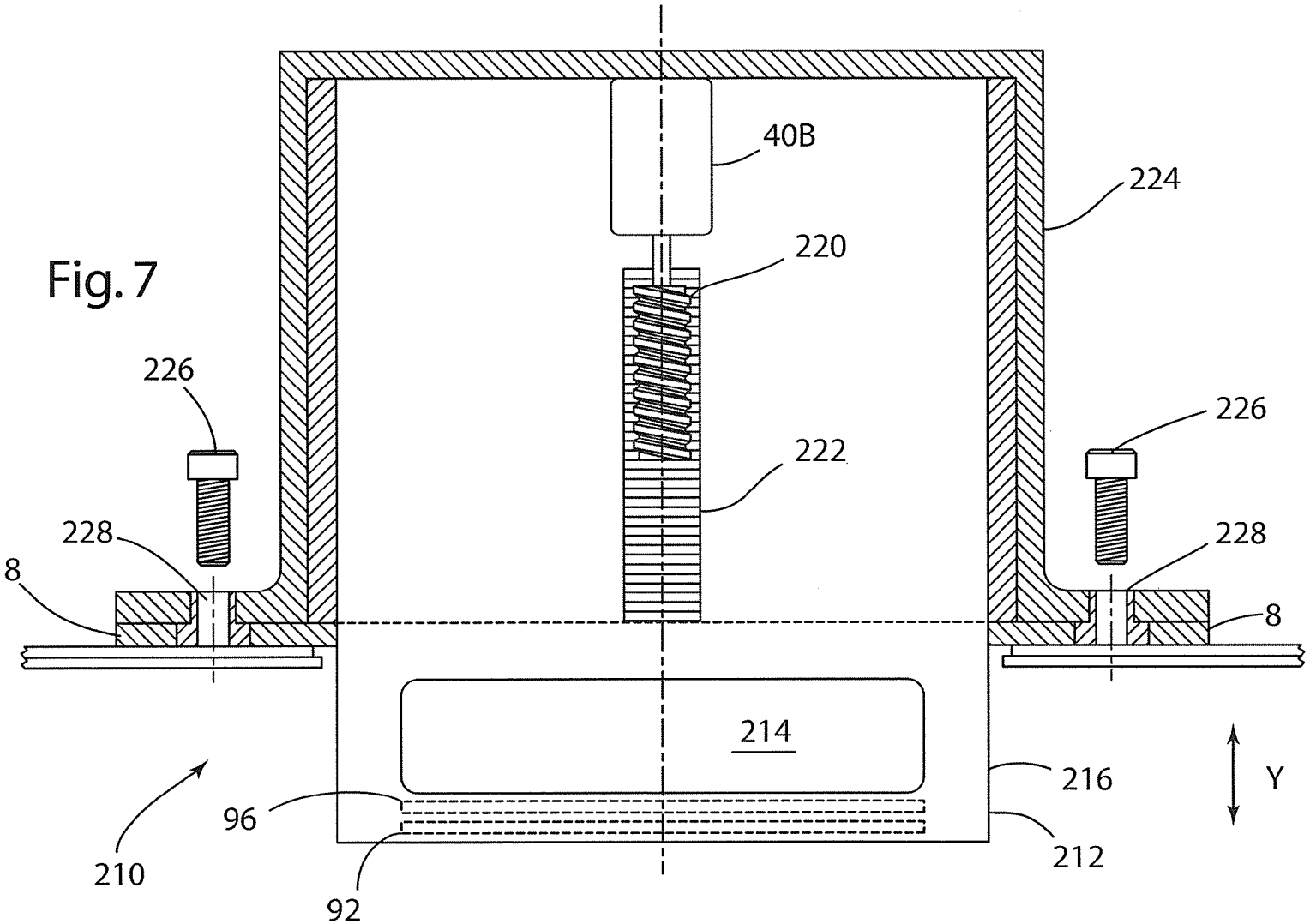
FIG. 7 is a cross-sectional plan view of a deployable door handle according to another aspect of the present invention.

With further reference to FIG. 7, a sliding handle assembly 210 according to another aspect of the present invention includes a handle 212 comprising a handle body 216 that is slidably received in a housing 224. The handle body 216 may have an antenna 92 disposed therein, as well as an unlock sensor 96. The antenna 92 and unlock sensor 96 operate in substantially the same manner as described in more detail above in connection with FIGS. 5 and 6. The sliding handle assembly 210 may include linear slides 194 as shown in FIG. 8. Handle assembly 210 includes an electric motor 40B that drives a worm gear 220. Worm gear 220 engages a linear rack 222 that is fixed to the handle body 216. Electric motor 40B is fixed to housing 224, such that actuation of electric motor 40B causes rack 222 and handle body 216 to shift inwardly and outwardly as shown by the arrow "Y" (FIG. 7). Threaded fasteners 226 and 228 may be utilized to secure housing 224 to a door structure 8. Handle assembly 210 may include position/stop sensors that are operably connected to a controller.

Handle assembly 210 operates in substantially the same manner as handle assemblies 150 and 250 described in more detail above in connection with FIGS. 5 and 6, respectively.

Figures 9, 10:
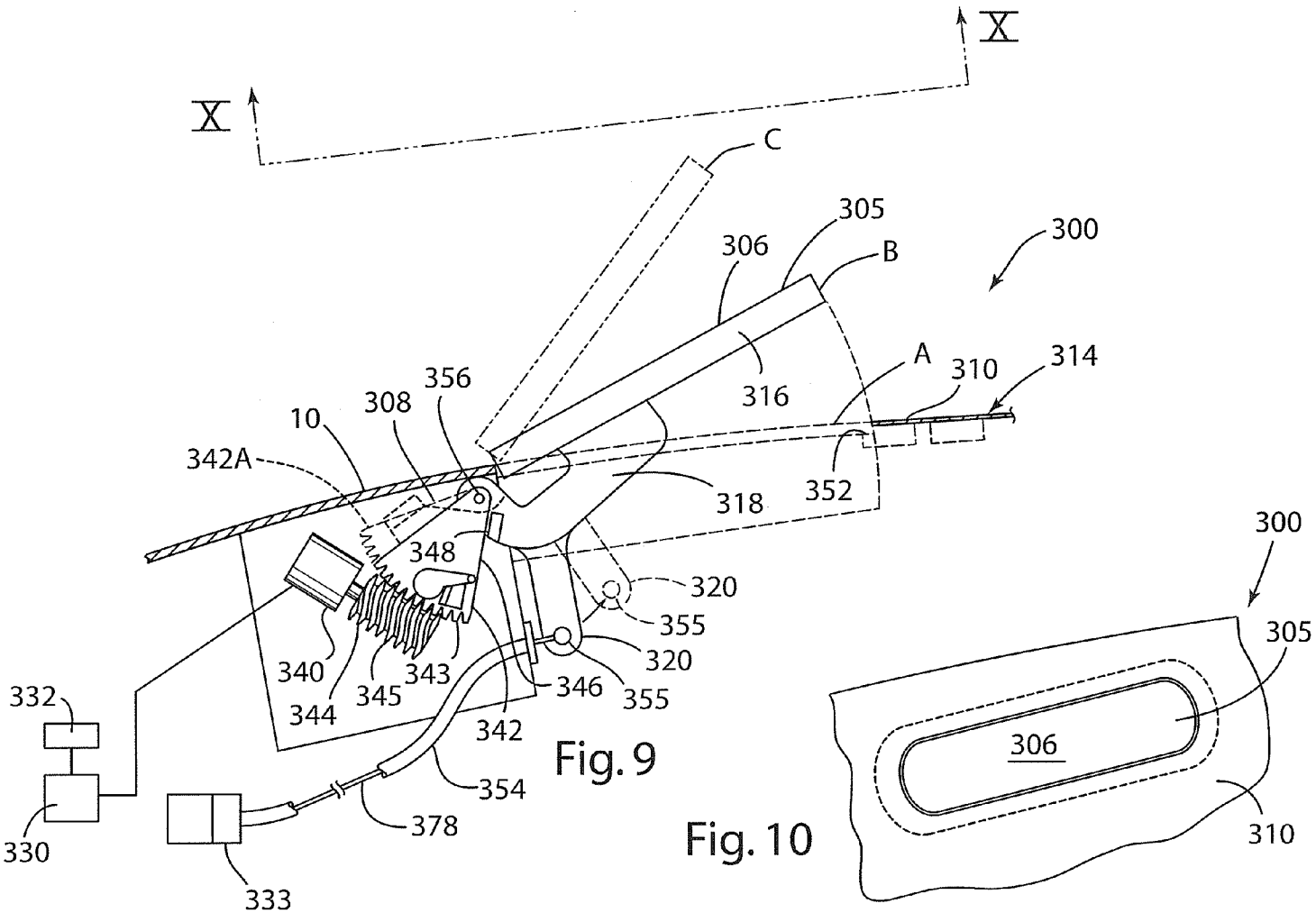
FIG. 9 is a partially schematic top plan view of a deployable door handle according to another aspect of the present invention.
FIG. 10 is a fragmentary view of the deployable door handle of FIG. 9 taken along the line X-X.

With further reference to FIGS. 9 and 10, a deployable handle system 300 according to another aspect of the present invention includes a handle member 305 that is rotatably mounted to a vehicle door structure 308 for rotation about a pin or shaft 356 forming a generally vertical axis relative to the vehicle. Outer surface 306 of handle member 305 may be painted to match finished surface 310 of the vehicle door 314. Handle member 305 includes an outer portion 316 forming outer surface 306, and an inwardly extending portion 318 that connects to pin or axis 356. An inwardly extending arm portion 320 forms a bell crank that pulls on a cable 354 to actuate a mechanical door latch 333. An end fitting 355 interconnects inner cable 378 to arm 320.

A gear member or segment 342 is rotatably mounted to pin or shaft 356, and includes gears 343 that engage gears 345 of a worm gear 344. Actuation of electric motor 340 rotates worm gear 344, thereby providing for powered rotation of gear segment 342 about pin or axis 356.

In operation, handle member 305 is initially in a retracted position "A" (FIG. 9) wherein outer surface 306 of handle member 305 is flush with finished surface 310 of vehicle door 314. Actuation of electric motor 340 causes gear segment 342 to rotate about pin 352. Edge surface 346 of gear segment 342 engages a stop or protrusion 348 on inner portion 318 of handle member 305, thereby rotating the handle member 305 outwardly from position A to position B. A user then grasps handle member 305 and pulls it outwardly to position C, thereby causing inner cable 378 to actuate door latch 333. The protrusion 348 pulls away from edge surface 346 of handle member 305 as handle member 305 is rotated (manually) outward from position B to position C, such that the motor 340 and gears 342 and 344 do not interfere or affect actuation of cable 354 and latch 333. After the latch 333 is actuated, the user releases handle member 305, and a torsion spring (not shown) causes the handle member 305 to rotate inward from position C to position B. The electric motor may be configured to return the gear segment 342 to its home position designated by the dashed lines 342A after actuation of mechanical latch 333. This permits the torsion spring to return the handle member 305 to the fully closed or initial position A.

A stop or the like 352 may be utilized to prevent rotation of handle member 305 beyond position A when handle member 305 travels to the closed position A. A rotational sensor (not shown) may be operably connected to controller 332 to thereby enable controller 330 to determine the position of handle member 305 at all times, and a switch or sensor (not shown) may be utilized to signal to the controller when handle member 305 is in the closed position.

Figure 12:
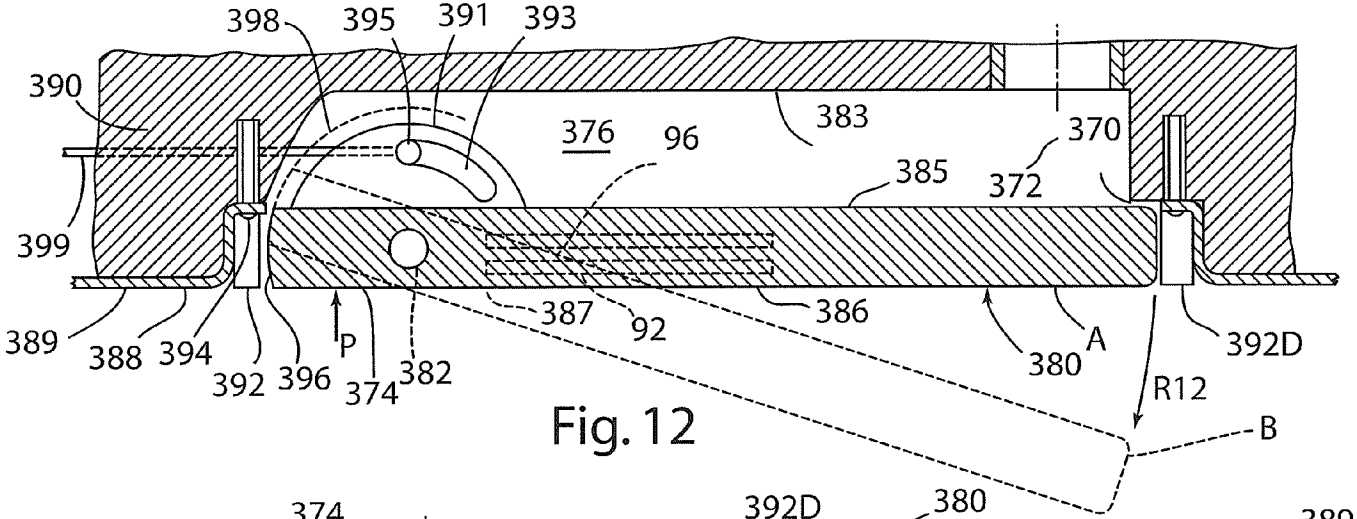
FIG. 12 is a cross sectional view of the deployable door handle of FIG. 11 taken along the line XII-XII.
Figure 11:
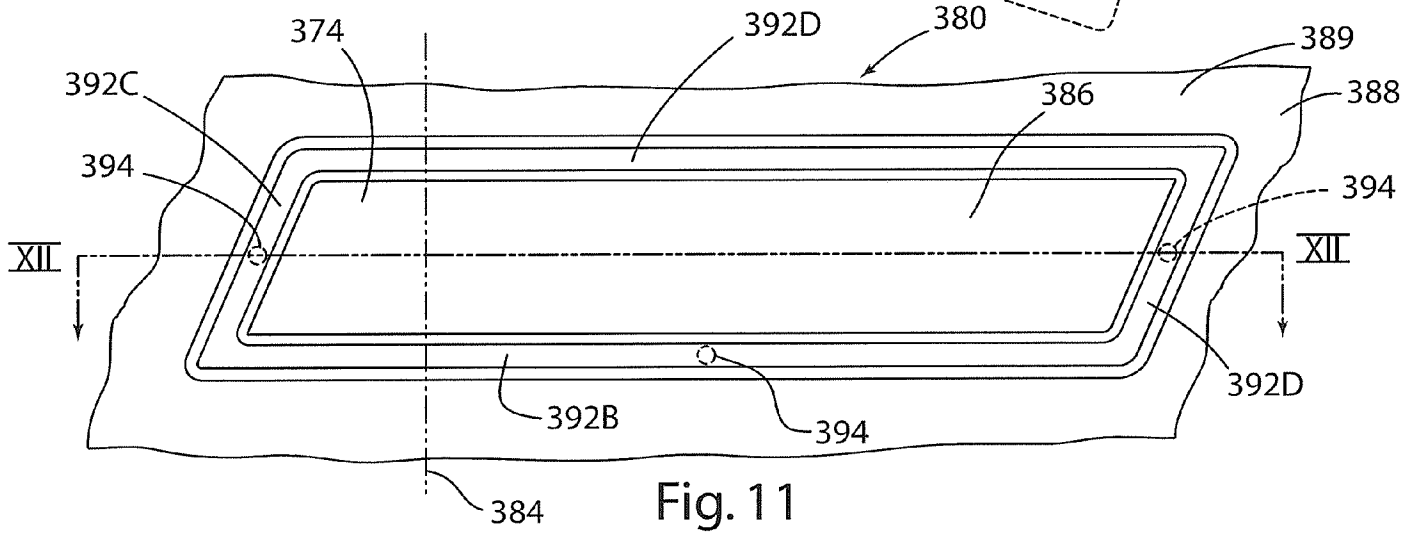
FIG. 11 is a partially fragmentary view of a deployable door handle according to another aspect of the present invention.

With further reference to FIGS. 11 and 12, a pivoting handle assembly 380 according to another aspect of the present invention includes a handle member 386 that is pivotably mounted to a pin or shaft 382 for rotation about a generally vertical axis 384. The pin 382 is mounted to door structure 390 and anchored to the handle housing or bezel. An outer skin or layer 388 of the vehicle door includes a finished outer surface 389. A bezel 392 is secured to the door structure 390 by a plurality of threaded fasteners 394. The bezel 392 in the illustrated example includes upper and lower horizontally extending sections 392A and 392B, respectively, and forward and rearward end portions 392C and 392D, respectively. The bezel segments 392A-392D together form a parallelogram. When the handle member 386 is in the closed position "A" (FIG. 12), outer surface 387 of handle member 386 is substantially flush with finished outer surface 389 of the vehicle door. As the handle member 386 rotates outwardly as shown by the arrow "R12", inner end 396 of handle member 386 follows a path 398 (FIG. 12).

Handle member 386 may comprise a bell crank having an extension 391 having an arcuate slot 393 therein. An end fitting 395 of a cable 397 is received in arcuate slot 393 to form a lost motion connection.

Inner surface 385 of handle member 386 is spaced apart from surface 383 of door 390 to form a gap or space 376. An antenna 92 and unlock sensor 96 may be positioned in the handle member 386 in substantially the same manner as described in more detail above in connection with the handles described in connection with FIGS. 1-10. In use, a user can push on inner end portion 374 of handle member 386 as shown by the arrow "P" (FIG. 12). This causes the handle member to rotate outwardly to a presented position "B." The handle member 386 can then be manually pulled outwardly to a fully deployed position (not shown) to release the vehicle door latch. As the handle member 386 is pulled outwardly from the position A to the position B, end fitting 395 of cable 397 slides along arcuate slot 393. However, one the handle member 386 reaches position B, further rotation of handle member 386 causes end fitting 395 to contact the end of arcuate slot 393, thereby generating a tension on cable 397 that opens the door latch. A spring or the like may be configured to bias the handle member 386 to the closed position.

Also, a detent or the like (not shown) may be utilized to releasably retain the handle member 386 in a fully closed position A. Handle member 386 may be configured such that the moment of inertia about axis 384 is even, such that a side impact on the vehicle does not generate a rotational force on handle member 386.

Alternately, the handle member 386 may be operably interconnected with the door structure 390 by a powered mechanism and gears as shown in FIGS. 2, 3, and 9. The electric motor can be actuated to initially move the handle member 386 from the closed position A to the intermediate position B, and the handle member can then be pulled to the fully open position by a user.

If handle assembly 380 comprises a powered version of the handle, the electric motor can first be actuated to shift the handle member from the fully retracted or closed position A to the intermediate position B. The drive mechanism for this would be substantially the same as discussed above in connection with FIGS. 2, 3 and 9. However, in the event the electric motor does not operate due to a power failure or the like, a user can then push on end region 374 of handle member 386 as shown by the arrow P to manually rotate the handle from position A to position B.

A lock cylinder 372 is normally hidden behind handle member 386. However, pivoting of handle member 386 to the intermediate position B exposes lock cylinder 372, and a user can then access the lock cylinders 382, and insert a conventional key into the lock cylinder 372 to unlock the door in the event there is a power failure in the vehicle. An elastic member 370 acts as a stop to prevent rotation of handle member 386 inwardly past the closed position A.

Each of the powered handle systems described above may also include a de-icing feature such as an electric heating element 98 (FIG. 4A). As discussed below, the electric heating element 98 may be operably connected to a thermometer and/or other control inputs to controller(s) 31 and/or 60. Heating element 98 may be mounted to the door structure 8 or at any suitable locations on the handle as may be required for a particular application. Heating element 98 can be molded into the handle body, and it can be integrated with the other handle/vehicle electronics. Also, the handle may include heat transfer channels that transfer heat from heating element 98 to other areas of the handle as required. Heating element 98 may comprise an electrical heating element such as a wire, or it may comprise an infra-red heater, a radiant heater, an electrochemical device, or other suitable heating element. Heating element 98 may be molded into the handle body, and be operably connected to a temperature sensor that monitors the external temperature. If the sensed external temperature falls below a predefined temperature (e.g. 38° F.), the heating element is turned on. The heating element may be variable, and the temperature of the outer surface or skin of the handle can be regulated to thereby prevent the formation of ice.

A de-icing approach according to another aspect of the present invention includes actuating the electric motor to shift the handle out slightly to break the ice. This could be done periodically according to predefined criteria, and could be combined with use of a heating element.

Another aspect of the present invention involves pushing the inner end 396 (FIG. 12) of a handle inwardly to break the ice. The handle member 386 can then be used to release the latch and open the door as described above.

Another way to address ice formation is to include an ultrasonic transducer that creates a high frequency vibration and breaks the ice. This function could be triggered by a feature similar to a remote start whereby a user pushes a button on a fob, and it would trigger the ultrasonic transducer to actuate and break free to break any formed ice. D-icing washer fluid could also be utilized along with the ultrasonic transducer, or by itself.

Yet another aspect of the present invention includes fabricating the handle such that the surface of the handle does not permit formation of ice. For example, a surface that does not permit ice to adhere thereto could be utilized to prevent formation of ice.

According to another aspect of the present invention, the cables or other mechanical connection to the latch shown in FIGS. 2 and 3 are optional, such that powered actuator 35 of latch 30 may provide for actuation of latch member 33 during "normal" operation (i.e. operation when the power to powered actuator is available and backup lock cylinder 26 does not need to be used.

Cables and lost motion mechanisms may (optionally) be utilized with the linearly translating handles of FIGS. 5, 5A, 6, 7, and 8 also, such that these handles may have a mechanical operation whereby the handle moves beyond the position B to mechanically unlock a latch. For example, with reference to FIG. 5, handle member 152 may include an elongated tab or other structure 146 having an elongated slot 147 that slidably engages an end fitting 148 of a cable 149. When the handle member 152 is fully retracted, end fitting 148 is in position "A." However, as handle member 152 is moved from position A to position B, end fitting 148 moves along elongated slot 147 until reaches the end position "B." Gear teeth 182 on racks 180A and 180B can be configured such that the end teeth 183A and 183B are just beginning to disengage from gears 186A and 186B, such that handle member 152 can then be manually pulled outwardly from position B to a fully deployed position. As the handle moves from position B to the fully deployed position, the handle pulls on cable 149 due to fitting 148 hitting the end of slot 147. This type of lost motion mechanism (FIG. 5) can, optionally, also be utilized with the linearly translating handles of FIGS. 5A, 6, 7 and 8. It will be understood that the position of the components of the lost motion mechanism may be selected to avoid mechanical interference with the other components.

In this way, the latch can also be mechanically released in a manner that is substantially similar to the arrangements discussed in more detail above in connection with FIGS. 2 and 3. Handle 152 and/or cable 149 may be spring biased inwardly, such that the handle 152 shifts from the fully deployed position back to position B when a user releases the handle member 152. The end gears 183A and 183B of racks 180A and 180B, respectively, are then in position to engage gears 186A and 186B upon actuation of electric motor 40A. It will be understood that the handle mechanisms of FIGS. 6 and 7 may include similar cable connections with lost motion features to provide for mechanical operation of the door latch.

The door handles described above may include a "mechanical" operation as described above wherein the handle is shifted from a fully closed position to a presented or intermediate position, and then pulled outwardly by a user to actuate the cable and door latch. Alternately, each of the handles described above may operate utilizing a fully powered door latch. When configured in this way, the door handle is shifted from a fully closed position to an intermediate position by a powered actuator such as an electric motor. A user then grasps the handle, and the switch/sensor in the handle combined with the door or body control module release the latch utilizing a powered actuator if various predefined conditions are met. If the door handle is configured in this way, a mechanical connection such as a cable between the handle and the latch is not required. This will be referred to as a powered latch version.

Operation of the door in a fully powered configuration will now be described. The door handle of FIGS. 1 and 2 will be used in the description, but it will be understood that the other handles described in more detail above may also be controlled in substantially the same manner. In use, if the powered latch assembly 30 is in a locked configuration, and a user approaches the vehicle, antenna 92 detects if the user has a keyless entry fob having a security code that is recognized by the system. If the system (e.g. keyless entry/door controller module 30) detects an authorized security code, the user is then authenticated, and the controller 31 is in an "authenticated" state. If a user has been authorized, the user can then place his or her hand (or other object) within a predefined distance of sensor 96, and controller 31 will then generate a signal causing powered latch 35 to shift to an unlatched configuration.

After the powered latch 35 shifts to the unlatched position, a user may pull the door to an open position. When a user closes the door it may be initially closed in a conventional manner by swinging the door shut. This causes the powered latch assembly 30 to shift to a latched configuration, holding the door in a closed position. If a user desires to lock the door from the outside, he or she actuates sensor or switch 25 by touching the surface of handle member 5 at sensor 25. It will be understood that the system may be configured to require that the switch 25 be actuated at the same time an authorized signal is received by antenna 92 and controller 31.

The invention claimed is:

1. A vehicle door including a deployable handle system, the door comprising:

a door adapted to be movably mounted to a vehicle for movement between open and closed positions, wherein the door includes a handle support structure and an exterior side surface, the door having an opening and an edge extending around the opening;

a latch mechanism selectively retaining the door in a closed position;

a handle member movably connected to the handle support structure for movement in a first direction from a retracted position wherein an outer surface of the handle member is substantially flush with the exterior side surface of the door to a deployed position, and for movement in a second direction from the deployed position to the retracted position, and wherein the handle member has an outer edge that fits closely adjacent the edge of the opening when the handle member is in the retracted position, and wherein at least a portion of the handle member is spaced-apart from the edge of the opening to define an access space when the handle member is in the deployed position such that a users' fingers can be inserted in the access space whereby a user is able to pull on the handle member to release the latch mechanism to open the door; and an electrically powered actuator operably connected to the handle and providing powered movement of the handle in at least one of the first and second directions to form or close off the access space.

2. The vehicle door of claim 1, wherein:

the latch mechanism includes a latch member; and the handle member is mechanically connected to the latch mechanism and shifts the latch member from a retained position to a released position upon application of a force on the handle member.

3. The vehicle door of claim 2, wherein:

the handle member is movable from the deployed position to a released position, and wherein movement of the handle member from the deployed position to the released position unlatches the latch mechanism.

4. The vehicle door of claim 1, wherein:

the handle member is pivotably connected to the handle support structure and rotates between the refracted and deployed positions.

5. The vehicle door of claim 4, wherein:

the handle member comprises an elongated structure having a base end that is pivotably connected to the handle support structure, and a free end that rotates outwardly away from the smooth exterior surface of the door.

6. The vehicle door of claim 5, wherein:

the handle member comprises a loop structure having a central opening therethrough having a portion thereof that is at least about one inch wide by three inches long whereby fingers of a user can extend through the opening and permit grasping of the handle member.

7. The vehicle door of claim 1, wherein:

the handle member is slidably connected to the handle support structure and moves linearly between the refracted and deployed positions.

8. The vehicle door of claim 7, wherein:

the outer handle surface is substantially planar.

9. The vehicle door of claim 1, wherein:

the latch mechanism includes a movable latch member; and the latch includes a powered actuator that shifts the latch member upon actuation of the powered actuator to latch and unlatch the latch mechanism.

10. The vehicle door of claim 9, wherein:

the handle member is slidably connected to the handle support structure and moves linearly between the refracted and deployed positions.

11. A vehicle door including a deployable handle system, the door comprising:

a door adapted to be movably mounted to a vehicle for movement between open and closed positions, wherein the door includes a handle support structure and an exterior side surface that is visible from outside the vehicle, the door having an opening and a peripheral edge extending around the opening;

a latch mechanism having a latch member that moves between retained and released positions to selectively retain the door in a closed position;

a handle member movably connected to the handle support structure for movement in a first direction from a retracted position to a deployed position, and for movement in a second direction from the deployed position to the retracted position, and wherein the handle member has oppositely-facing inner and outer surfaces and a peripheral outer surface extending around the handle member and defining an outer edge and wherein the outer edge of the handle fits closely adjacent the edge of the opening and closes off access to the inner surface of the handle member when the handle member is in the retracted position, and wherein at least a portion of the outer edge of the handle member is spaced-apart from the peripheral inner surface of the opening to define an access space when the handle member is in the deployed position such that a users' fingers can be inserted in the access space enabling a user's fingers to contact the inner surface of the handle member enabling a user to pull on the door to move the door from a closed position to an open position;

a powered actuator operably connected to the handle and providing powered movement of the handle in at least one of the first and second directions and selectively opening or closing the handle member to form the finger access space;

the latch includes a powered actuator that shifts the latch member upon actuation of the powered actuator;

the handle member is slidably connected to the handle support structure and moves linearly between the refracted and deployed positions;

the handle member is slidably connected to the handle support structure for movement between the retracted and deployed positions; and includes:

an electric motor including a rotating shaft having first and second drive gears mounted on opposite ends of the shaft;

a pair of spaced-apart rotating gears engaging the first and second drive gears; and a pair of spaced-apart toothed racks engaging the rotating gears and shifting the handle inwardly and outwardly between the retracted and deployed positions upon actuation of the electric motor.

12. The vehicle door of claim 11, wherein:

the electric motor and the rotating gears are mounted to the support structure, and the racks are mounted to the handle member and move with the handle member.

13. The vehicle door of claim 12, wherein:

each rotating gear includes a first gear section defining a first diameter and a second gear section defining a second diameter that is significantly smaller than the first diameter, and wherein the first gear sections engage the first and second drive gears, and the second gear sections engage the racks.

14. The vehicle door of claim 13, wherein:

the first and second drive gears comprise worm gears.

15. The vehicle door of claim 14, wherein:

the first and second drive gears have teeth that spiral in opposite directions and cause the rotating gears to rotate in opposite directions.

16. The vehicle door of claim 15, wherein:

the rotating gears define axes of rotation and comprise helical gears having teeth formed on a helical path about the axis of rotation.

17. The vehicle door of claim 15, wherein:

the rotating gears define axes of rotation and comprise worm gears having teeth extending outwardly away from the axes of rotation.

18. The vehicle door of claim 11, wherein:

the electric motor and the rotating gears are mounted to the support, and the racks are mounted to the handle and move with the handle.

19. A vehicle door, comprising:

a support;

a handle slidably connected to the support;

an electrically powered motor including a rotating shaft having first and second drive gears mounted on opposite ends of the shaft;

a pair of spaced-apart rotating gears engaging the first and second drive gears; and a pair of spaced-apart toothed racks engaging the rotating gears and shifting the handle inwardly and outwardly upon actuation of the electrically powered motor.

* * * * *